US005351737A

United States Patent [19]

Hoshiyama

[11] Patent Number: 5,351,737

[45] Date of Patent: Oct. 4, 1994

[54] PLEATED SCREEN DEVICE BASED ON WIRE TENSION SYSTEM

[75] Inventor: Yasuo Hoshiyama, Tokyo, Japan

[73] Assignee: Metaco Inc., Tokyo, Japan

[21] Appl. No.: 987,595

[22] Filed: Dec. 9, 1992

[30] Foreign Application Priority Data

Dec. 26, 1991 [JP] Japan ..... 3-345386

[51] Int. Cl.[5] ..... E06B 3/94

[52] U.S. Cl. ..... 160/84.1 B; 160/84.1 E

[58] Field of Search ..... 160/84.1 R, 279, 115, 160/84.1 D, 84.1 C, 84.1 E, 84.1 B

[56] References Cited

U.S. PATENT DOCUMENTS 4,326,577 4/1982 Tse ..... 160/279 X
4,473,101 9/1984 Langeler ..... 160/84.1
4,574,864 3/1986 Tse ..... 160/279 X
4,733,711 3/1988 Schon ..... 160/84.1
4,762,159 8/1988 Ford .
4,852,627 8/1989 Peterson et al. .
4,862,941 9/1989 Colson .

FOREIGN PATENT DOCUMENTS 3-29957 4/1991 Japan .

*Primary Examiner*—David M. Purol
*Attorney, Agent, or Firm*—Wenderoth, Lind & Ponack

[57] ABSTRACT

A sliding bar slidable in opening-closing directions of a pleated screen device has therein a plurality of direction changing members each defining an arcuate guide surface. At least one end of wire of a tension system of the device is fixed. The wire may be formed of two cords, for example. These two cords are stretched between a pair of frame members, turned by the guide surface of a plurality of the direction changing members in the sliding bar, cross over each other in the sliding bar, and extend into each of the frame members. A pleated screen is foldable and spreadable between the sliding bar and a frame member opposed to the sliding bar. The pleated screen is supported in the opening-closing directions by the cords.

21 Claims, 14 Drawing Sheets

PLEATED SCREEN DEVICE BASED ON WIRE TENSION SYSTEM

BACKGROUND OF THE INVENTION

1. Field of the Invention

The present invention relates to a pleated screen device. More particularly, the present invention relates to a novel pleated screen device using a wire tension system, applicable as a curtain, blind, partition or screen door, and which can be simply and easily opened and closed in a smooth manner.

2. Description of the Prior Art

Curtains, blinds, movable partitions and screens having various configurations and structures have conventionally been used in windows or as a partition in homes and office buildings. As one of such devices, a pleated screen device is known which has a foldable and spreadable screen formed of a plurality of pleats.

One of these pleated screen devices has a pleated screen arranged between a head box and a bottom rail, and a lifting cord extending vertically through the screen, an end of the lifting cord being fixed to the bottom rail. The pleated screen is folded and spread by raising and lowering the lifting cord, whereby a window is exposed and covered.

In the above-mentioned pleated screen device, however, the screen is only suspended with the lifting cord, thus presenting various difficulties in opening and closing the device, such as the screen becoming inclined due to a difficulty in creating parallel movement of both sides of the screen, and bending of the lifting cord.

To solve these problems, another pleated screen device has been provided in which the lifting cord does not pass through the screen; rather, two rod members extend vertically between upper and lower frame members and through the screen. In this pleated screen device, the rod members guide the screen as it is raised and lowered with the lifting cord.

Further, another pleated screen device has been provided in which two rod members extend between a pair of frame members and through the screen. In this device, a sliding bar having a knob is fixed to an end of the screen, and the screen is opened and closed by moving this sliding bar horizontally.

In this pleated screen device, however, while relatively smooth opening and closing operations of the screen are achievable, there are some problems in that the rod members hinder the opening and closing operations of the window and limit access by the user, for example, when the device is provided in a window frame or as a partition. When opening the screen, furthermore, the rod members project from the opening, thus impairing the view.

SUMMARY OF THE INVENTION

An object of the present invention is to provide a pleated screen device employing a wire tension system, applicable for use as a curtain, blind, partition or screen door, and which permits a simple and easy opening and closing of a screen in a smooth manner.

To achieve this object, the present invention provides a pleated screen device employing a wire tension system and comprising: one or more sliding bars slidable in opening-closing directions of the device; a plurality of direction changing means provided in the sliding bar; one or more foldable and spreadable pleated screens having a plurality of pleats, at least one end of which is secured to one of said sliding bars; and wire including one or more cords stretched in said opening-closing directions of the device, and having at least one fixed end, said wire supporting said pleated screen at both sides thereof in the opening-closing directions, turned by a plurality of the direction changing means in at least one of the sliding bars, and having portions crossing one another in the sliding bar.

The present invention also provides a pleated screen device employing a wire tension system and comprising: a frame having two pairs of frame members, one of which forms upper and lower sides of the frame, and the other of which forms right and left sides of the frame; a sliding bar slidable in opening-closing directions of the device; a plurality of direction changing means provided in the sliding bar; a foldable and spreadable pleated screen having a plurality of pleats, and supported between the sliding bar and one of the frame members opposed to the sliding bar; and two cords stretched between a pair of the frame members so as to support the pleated screen in the opening-closing directions of the device, wherein the cords are turned by a plurality of the direction changing means in the sliding bar, cross each other in the sliding bar, and are respectively inserted into a pair of the frame members opposed in the opening-closing directions of the device.

The present invention also provides a double sliding type of pleated screen device employing a wire tension system and comprising: two sliding bars slidable in opening-closing directions of the device; two frame members, and each of which is opposed to one of the sliding bars; a pair of pleated screens having a plurality of pleats, and each of which is foldable and spreadable between a sliding bar and the frame member opposed thereto; and wire including cords supporting each or both of the pleated screens.

The present invention also provides a double sliding type of pleated screen comprising: an even number of sliding bars; a plurality of direction changing means provided in the sliding bars; pleated screens each having a plurality of pleats, some of which are foldable and spreadable between a frame member extending perpendicular to opening-closing directions of the device and a sliding bar opposed to the frame member, and others of which are foldable and spreadable between the other sliding bars; and wire including an even number of cords turned by a plurality of the direction changing means in at least one of said sliding bars, crossing one another in the sliding bar and inserted into frame members opposed in the opening-closing directions of one device, the wire supporting the pleated screen in the opening-closing directions of the device.

DETAILED DESCRIPTION OF THE PREFERRED EMBODIMENTS

Now, a pleated screen device employing a wire tension system according to the present invention will be described in further detail with reference to the accompanying drawings.

Figure 1:
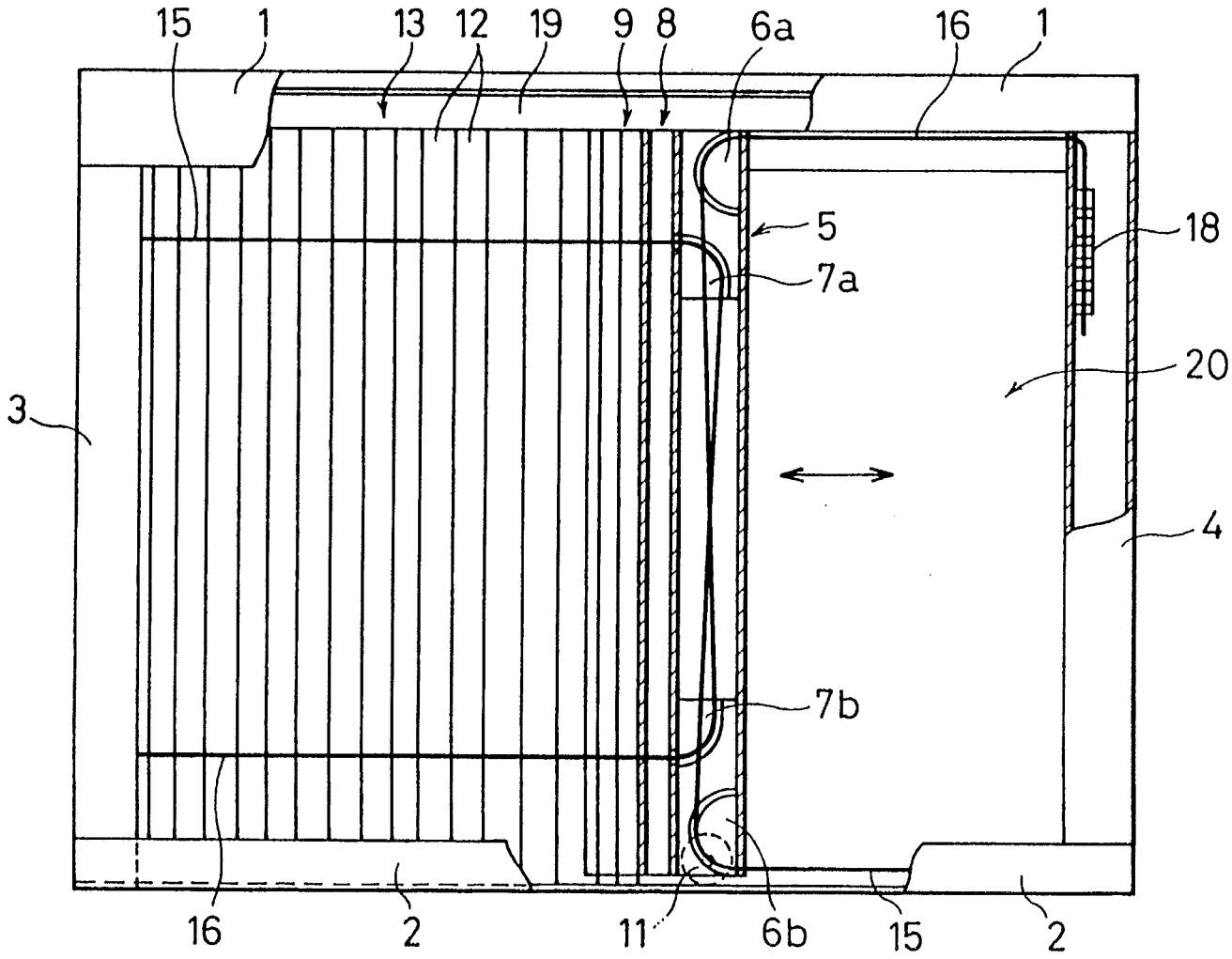
FIG. 1 is a partially broken away front view of an embodiment of a pleated screen device having a wire tension system according to the present invention.
Figure 2:
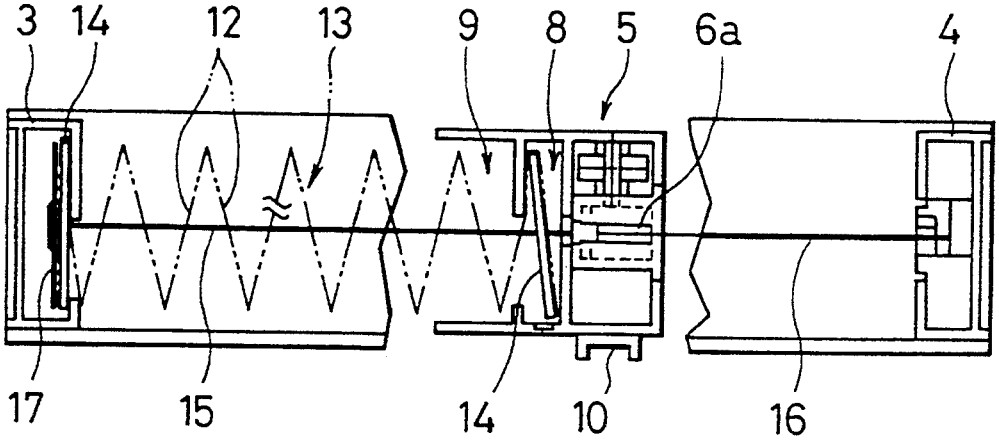
FIG. 2 is a plan view, also partially broken away, of the embodiment shown in FIG. 1.

FIGS. 1 and 2 depict an embodiment of a pleated screen device capable of being horizontally opened and closed.

This pleated screen device includes a frame constituted by upper and lower frame members (1) and (2) and right and left frame members (3) and (4). Actually, an independent frame is not always a necessary part of the pleated screen device of the present invention. If a pleated screen device is installed in an opening of a window, a sash frame of the window will serve as the frame of the pleated screen device. In any case, the pleated screen device is integrated with a frame when installed at a prescribed position.

A sliding bar (5) is provided between the upper frame member (1) and the lower frame member (2) so as to be slidable in the horizontal direction. In this case, the frame members (1) and (2) may be used as a guide for the sliding bar (5). It is not always necessary for the sliding bar (5) to be vertical during its sliding movement relative to the frame members (1) and (2). The sliding bar (5) may be slidable while at an oblique angle to the frame members (1) and (2). The angle may be selected based on the shape of the structure where the pleated screen device is installed.

Two pairs of gliding members (6*a*) and (6*b*), and (7*a*) and (7*b*) for changing the direction of a wire member are provided in the sliding bar (5). As shown in FIG. 2, the sliding bar (5) has a supporting portion (8) and a housing portion (9) for supporting and housing a pleated sceen. A knob (10) is provided for allowing the sliding bar (5) to be manually slid by hand. As shown in FIG. 1, a door roller (11) is rotatably supported at the lower end of the sliding bar (5). This door roller (11) facilitates smooth sliding movement of the sliding bar (5).

A foldable and spreadable pleated screen (13) having a plurality of pleats (12) is provided between the sliding bar (5) and the left frame member (3). As shown in FIG. 2, a supporting member (14) is attached to each end of the pleated screen (13), and hence the pleated screen (13) is firmly supported by means of those supporting members (14) between the frame member (3) and the supporting portion (8) of the sliding bar (5). There is no particular limitation with regard to the material for the pleated screen (13). Any of a cloth, a sheet, a film and a net capable of forming pleats (12) may be used. The pleats (12) may also have any configuration.

Figure 3:
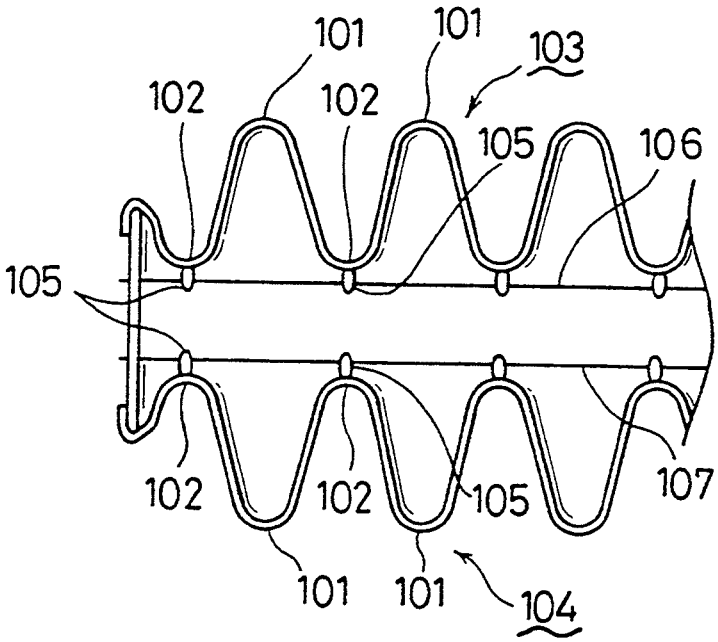
FIGS. 3, 4, 5, 6 and 7 are respective partial sectional views of other embodiments of a pleated screen and supporting system of pleated screen devices according to the present invention.
Figure 4:
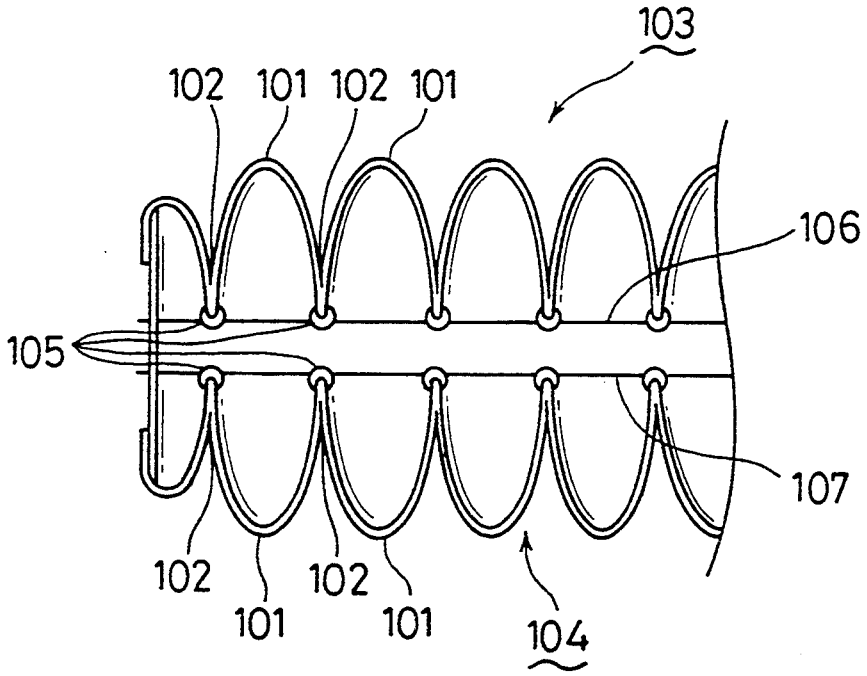
Figure 5:
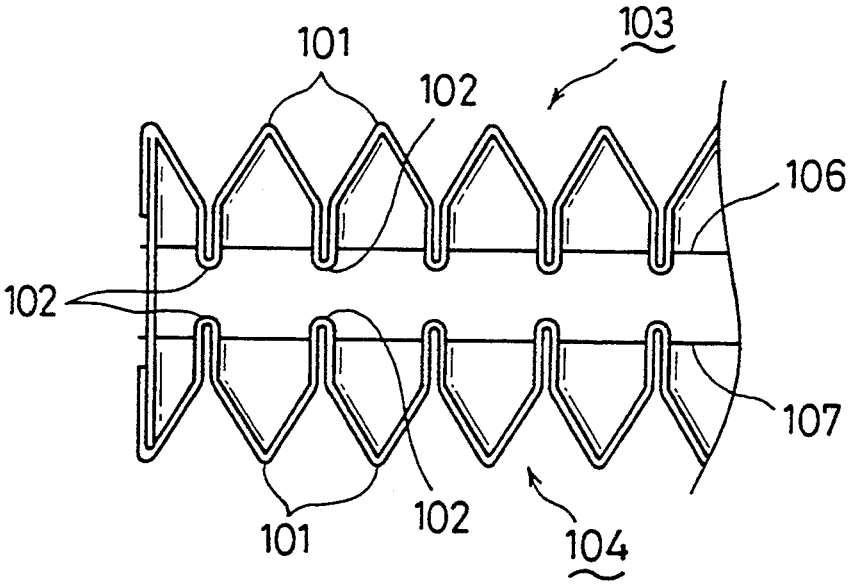
Figure 6:
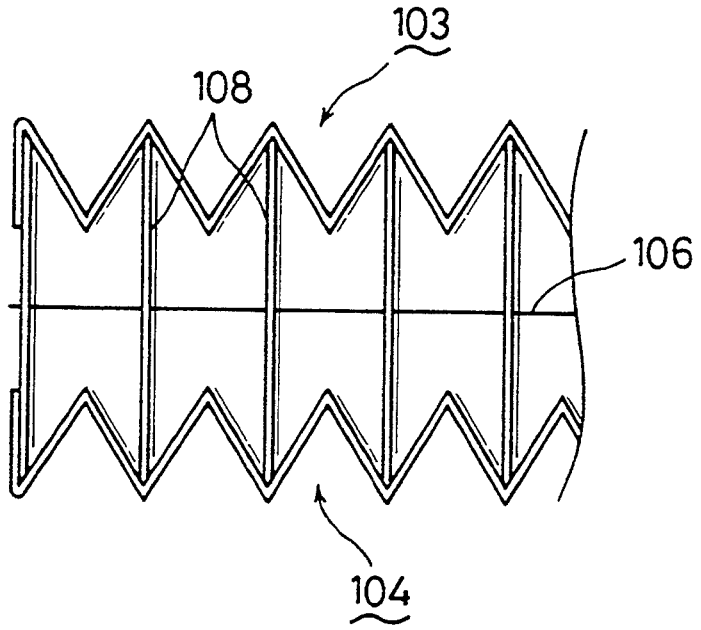
Figure 7:
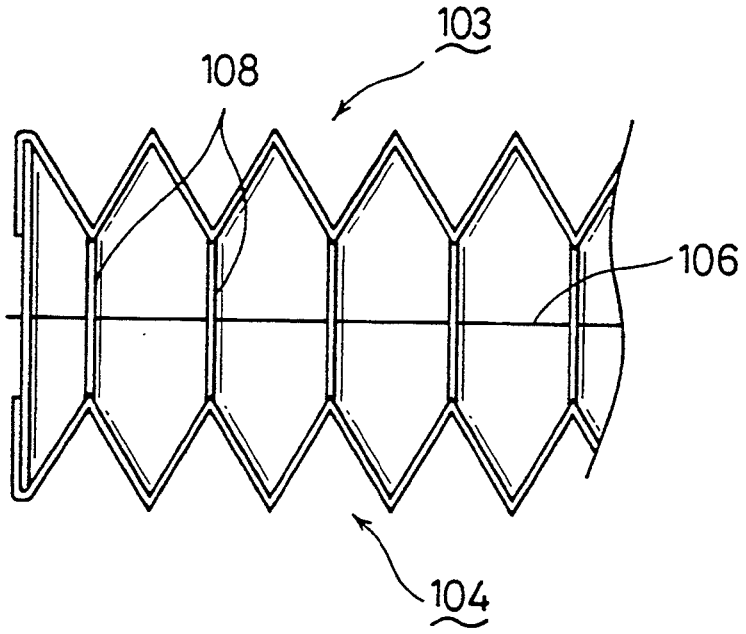

As shown in FIG. 1, a pair of upper and lower cords (15) and (16), constituting the wire which supports the pleated screen (13), extend in opening-closing directions of the pleated screen (13), i.e., in the horizontal direction. These cords (15) and (16) may be passed through, for example, a small bore provided in the pleats (12) of the pleated screen (13) or may be attached to the front or back surface of the pleated screen (13) by appropriate fasteners. As shown in FIGS. 3 and 4, for example, when the pleated screen is constituted by two flexible sheets (103) and (104) having crests (101) and troughs (102), ring members (105) may be secured to a body of the pleated screen (13) at the troughs (102) of the back surface of each sheet (103) and (104) and the cords (106) and (107) may be passed through those ring members (105). As shown in FIG. 5, the cords (106) and (107) may directly be passed through the sheets (103) and (104) without using ring members. For a honeycomb type of pleated screen as shown in FIGS. 6 and 7, the cords (106) may be passed through connecting pieces (108) internally connecting the sheets (103) and (104). Any appropriate wire may be selected, for example, in response to the configuration of the pleats of the pleated screen.

As shown in FIG. 2, the left ends of the cords (15) and (16) are secured to the frame member (3) by means of a metallic fixture (17). As shown in FIG. 1, the upper cords (15) horizontally supports the pleated screen (13), then is guided downwardly by the arcuate guide surface of a gliding member (7*a*) provided in the sliding bar (5), is turned by the guide surface of another gliding member (6*b*) provided at the lower end of the sliding bar (5), extends into the lower frame member (2), and is fixed to the right frame member (4). The lower cord (16) supports, on the other hand, the pleated screen (13) in the horizontal direction, is turned by the gliding members (7*b*) and (6*a*) provided in the sliding bar (5), crosses over the cord (15), extends into the upper frame member (1), and is fixed to the frame member (4) by means of a metallic fixture (18). There is no particular limitation as to the material for those cords (15) and (16). The cords may be made of metals, alloys and hard resins. The means for fixing the cords (15) and (16) to the frame members (3) and (4) is not limited to the metallic fixtures (17) and (18) shown in FIGS. 1 and 2. Any means capable of giving a prescribed tension, and of supporting and fixing the cords (15) and (16) in a tensioned state may be employed. It is also possible to operatively connect a tension adjusting member, such as a coil spring, to the cords (15) and (16). Depending upon the configuration of the pleated screen (13), as shown in FIGS. 3, 4 and 5, a plurality of cords such as two cords (106) and (107) may be used instead of a single piece of wire. In this case, the plurality of cords perform the same function as the single wire cord. Further, the cords (15) and (16)

may possibly be connected to each other so as to constitute a single wire.

In the embodiment shown in FIG. 1, a ceiling panel (10) for creating tightness with the screen contacts the upper end portion of the pleated screen (13) under its own weight and is provided in the interior of the upper frame member (1).

Figure 8:
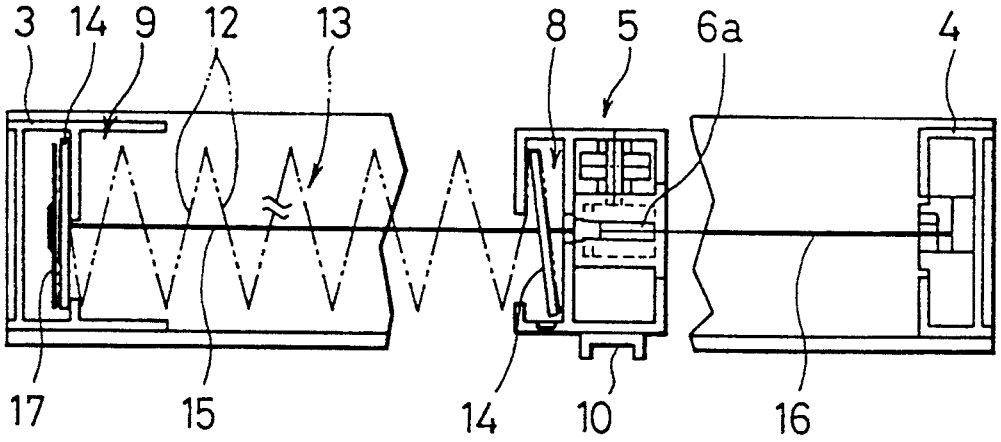
FIG. 8 is a plan view, partially broken away, of another embodiment of a pleated screen device according to the present invention.

In the embodiment as described above, the gliding members (*6a*), (*6b*), (*7a*) and (*7b*) provided in the sliding bar (5) change the direction of the cords (15) and (16), cause the cords (15) and (16) to cross over each other, and provide them with a prescribed tension between the right frame member (3) and the left frame member (4). Because the cords (15) and (16) can smoothly slide on the gliding members (*6a*), (*6b*), (*7a*), and (*7b*), the sliding bar (5) can easily travel in the horizontal direction, and this travel of the sliding bar (5) permits a free change in the horizontal lengths of the cords (15) and (16) at the pleated screen (13) and at the opening (20). The change in the horizontal lengths of the cords (15) and (16) at the pleated screen (13) causes the pleated screen (13) to be folded or spread while the same is guided. More specifically, by sliding the sliding bar (5) toward the side of the frame member (4), the horizontal lengths of the cords (15) and (16) at the pleated screen (13) are increased, and the pleats (12) in the founded state are thus spread. This makes it possible to close the pleated screen member (13) and hence to shut the opening (20). When sliding the sliding bar (5) toward the frame member (3), the horizontal lengths of the cords (15) and (16) at the pleated screen (13) are reduced, and the pleats (12) are pushed and folded. It is thus possible to open the pleated screen (13) and form the opening (20). The folded pleated screen (13) is housed in the housing portion (9) forming part of the sliding bar (5) shown in FIG. 2. As shown in FIG. 8, on the other hand, the housing portion (9) may form part of the frame member (3) which supports the pleated screen (13).

The pleated screen (13) guided by the upper and lower wire members such as the cords (15) and (16) never becomes inclined during the opening and closing operations but is smoothly folded or spread during such operations. Because of the uniform operational load acting on the sliding bar (5), it is possible to cause the sliding bar (5) to freely travel and to stably open and close the pleated screen (13) irrespective of the point at which the sliding bar (5) is operated on. This permits simple and easy opening and closing operations and ensures that the bar may be easily stopped at any position. The cords (15) and (16) add strength to the pleated screen (13). A swinging of the pleated screen (13) by the wind is prevented. Since each of the cords (15) and (16) at the side of the opening (20) is inserted into the upper or lower frame member (1) or (2), the cords (15) and (16) are never left exposed in the opening (20) when opening the pleated screen (13). This allows a user to experience a satisfactory exterior view through the opening (20). When the device is provided in a window frame or as a partition, the opening and closing operations of the window or access of a user are not hindered.

Figure 9:
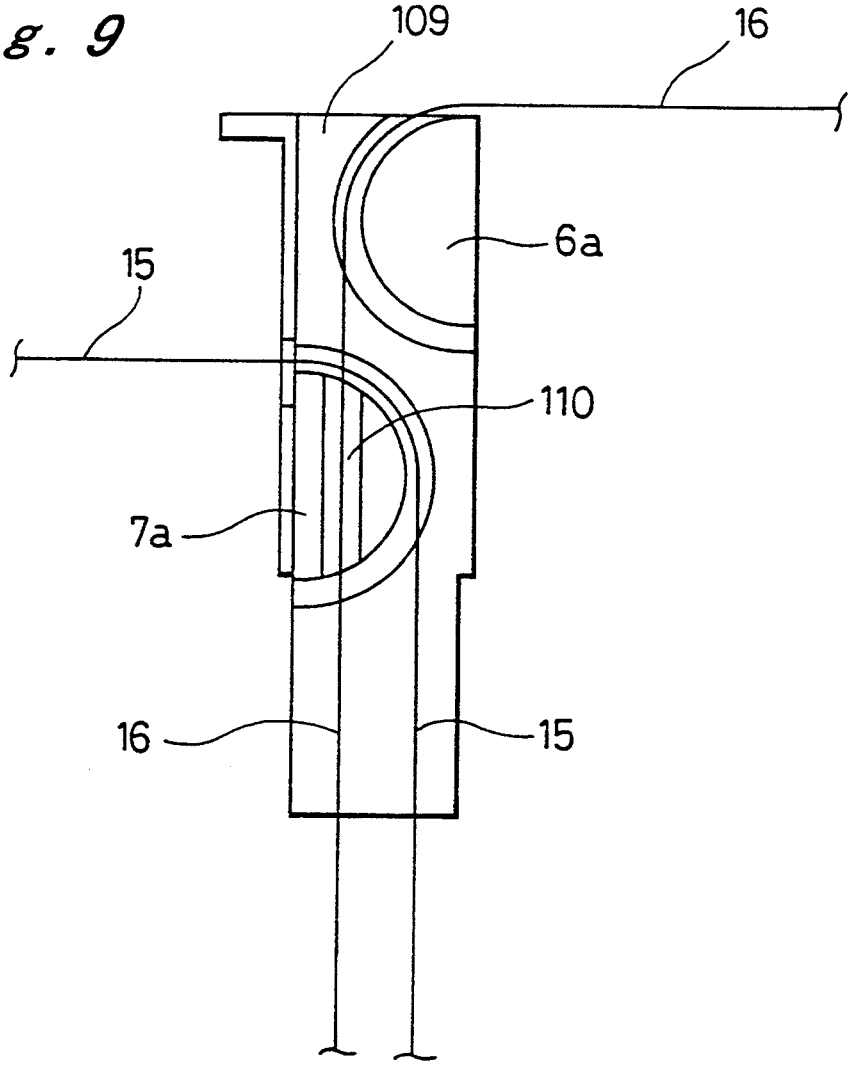
FIG. 9 is a side view of direction changing means of a pleated screen device according to the present invention.

In the embodiment of FIG. 9, the upper gliding members (*6a*) and (*7a*) and the lower gliding members (*6b*) and (*7b*) respectively provided in the sliding bar (5) shown in FIG. 1 are each integrated respective sets.

Gliding members (*6a*) and (*7a*) having substantially semi-circular guide surfaces form a gliding member unit (109) wherein the gliding member (*6a*) is disposed above the gliding member (*7a*). A channel (110) is formed in the longitudinal direction of the unit (109) in the gliding member (*7a*) which turns back the cord (15) extending into the sliding bar (5) from the pleated screen (13). In the gliding member unit (109), the cord (16) extends into the channel (110) in the gliding member (*7a*) in the sliding bar (5), extends over the other gliding member (*6a*), and is turned towards the opening. This allows the sliding bar (5) to be compact.

Figure 10:
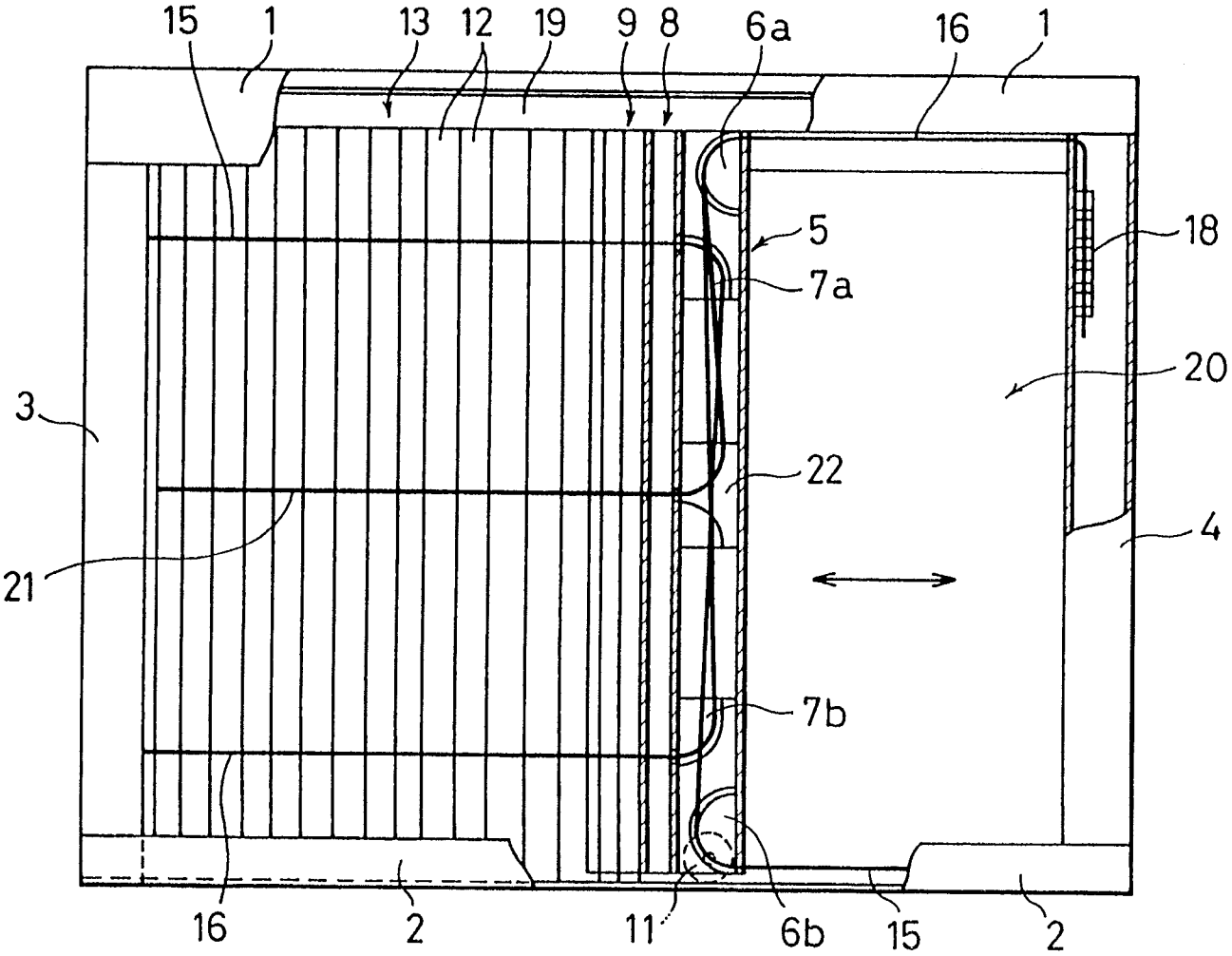
FIG. 10 is a partially broken away front view of another embodiment of a pleated screen device according to the present invention.

In an embodiment shown in FIG. 10, an auxiliary cord (21), constituting intermediate wire, is provided between the upper cord (15) and the lower cord (16) and supports the pleated screen (13) at the center of the screen. A midway glide member (22) for changing the direction of this intermediate cord (21) is provided in the sliding bar (5).

An end portion of the intermediate cord (21) is secured by a metallic fixture (17), for example, to the frame member (3) for fixing the pleated screen (13). After this intermediate cord (21) is turned by the midway glide member (22) provided in the sliding bar (5), the cord (21) is then hooked to the gliding member (*6a*) in the sliding bar (5), turned back by this gliding member (*6a*), extends into the upper frame member (1), and is fixed to the frame member (4) together with the cord (16) by means of the metallic fixture (18).

The intermediate cord (21) prevents bending of the pleated screen (13) under the effects of wind during the spreading of the screen (13), and reinforces the entire face of the pleated screen (13). It also functions to correct a possible deformation of the pleated screen (13) under the effects of temperature, for example. The intermediate cord (21) may be connected to the cords (15) and (16), and the upper and lowers cords (15) and (16) and the intermediate cord (21) may form a single piece of wire.

Figure 11:
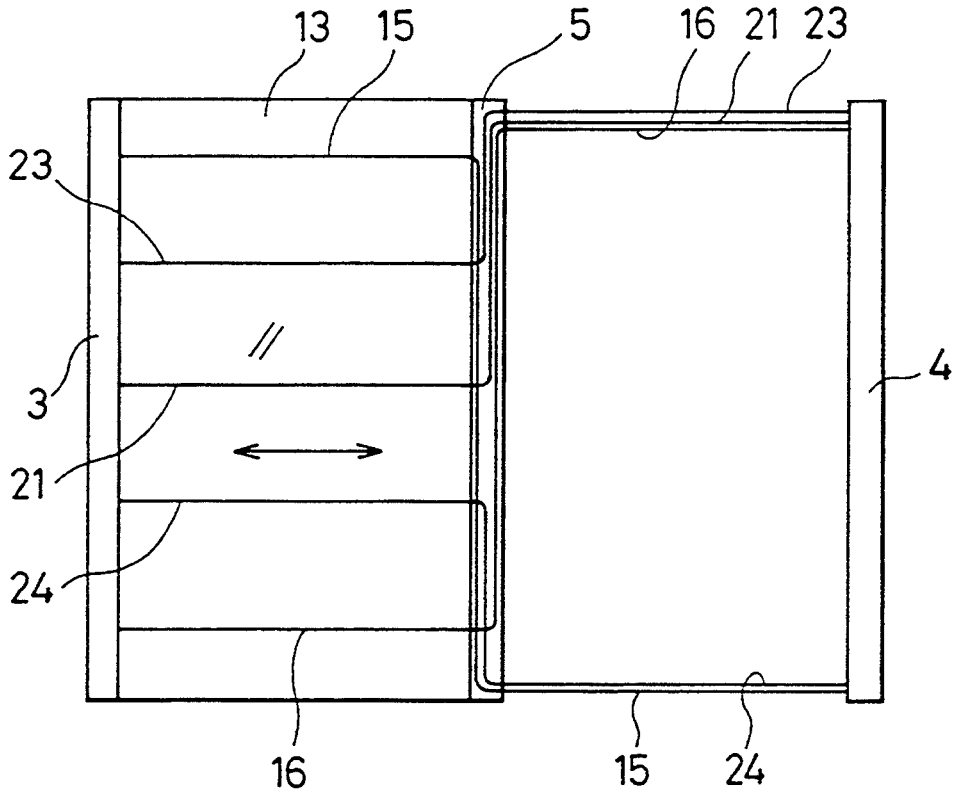
FIG. 11 shows a configuration of another embodiment of a pleated screen device using an intermediate wire.

In this embodiment, the intermediate cord (21) is turned upwardly in the sliding bar (5). The invention is not, however, so limited as the cord (21) may be turned downwardly. There is also no particular limitation regarding the number of intermediate cords that may be employed. An appropriate number may be selected depending upon the strength and the size of the pleated screen (13). As shown in FIG. 11, for example, additional cords (23) and (24) may be provided between the cords (15) and (16) and the intermediate cord (21) shown in FIG. 10. In this case, a glide member similar to the midway glide member (22) shown in FIG. 10 may be provided at a position corresponding to the intermediate cords (23) and (24) in the sliding bar (5). The pleated screen device of the present invention may have an appropriate height and size based or independently of the size of the installation space.

Figure 12:
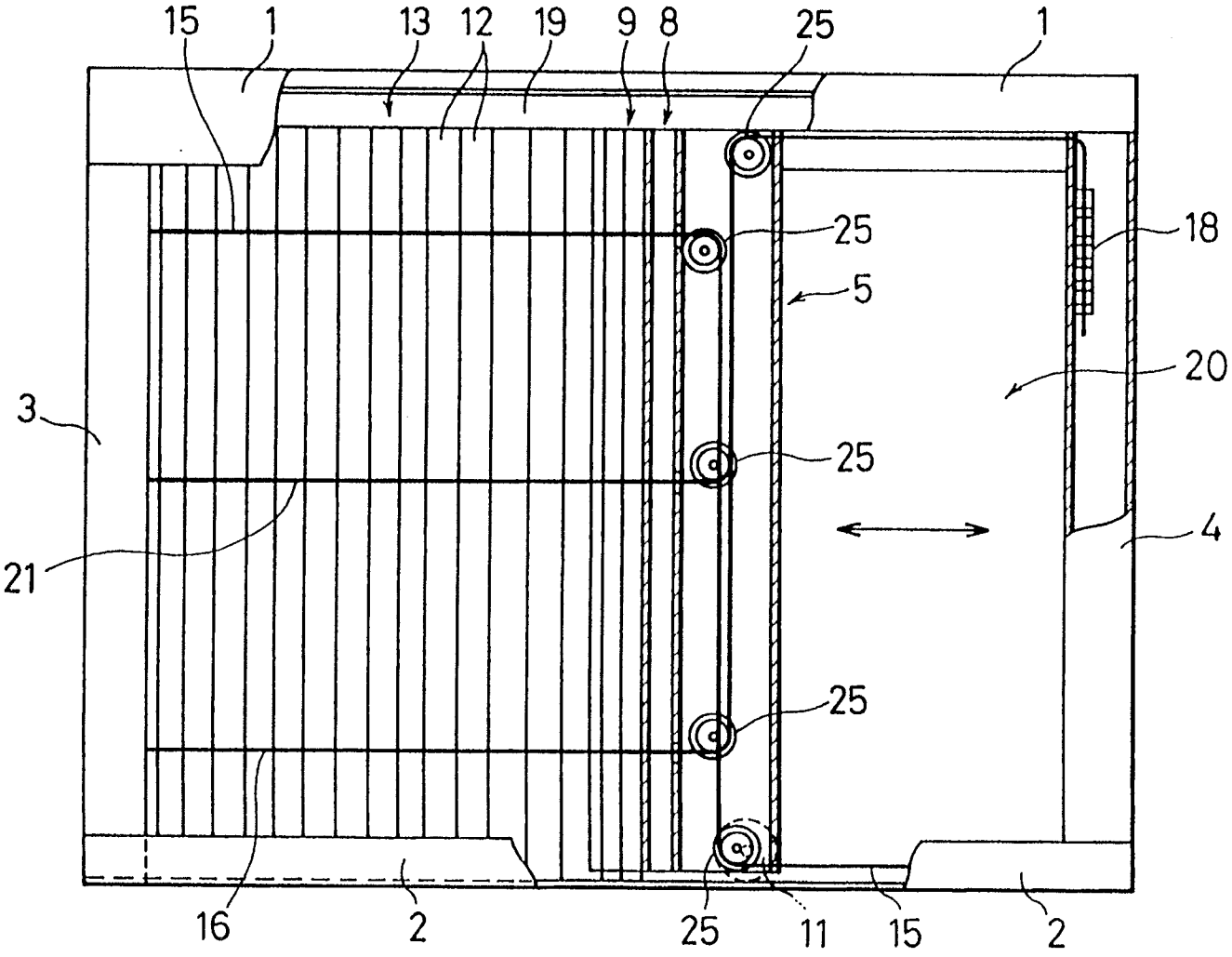
FIG. 12 is a partially broken away front view of another embodiment of the present invention.

In an embodiment shown in FIG. 12, pulleys (25) each having an endless arcuate guide surface are adopted as direction changing means which turn the cords (15) and (16) and the intermediate cord (21) and cause them to cross one another, and impart tension to the cords between the right frame member (3) and the left frame member (4). The pulleys (25) are rotatably provided in the sliding bar (5). The pulleys (25) ensure that the cords (15) and (16) and the intermediate cord (21) are stretched with a prescribed tension between the frame members (3) and (4).

Figure 13:
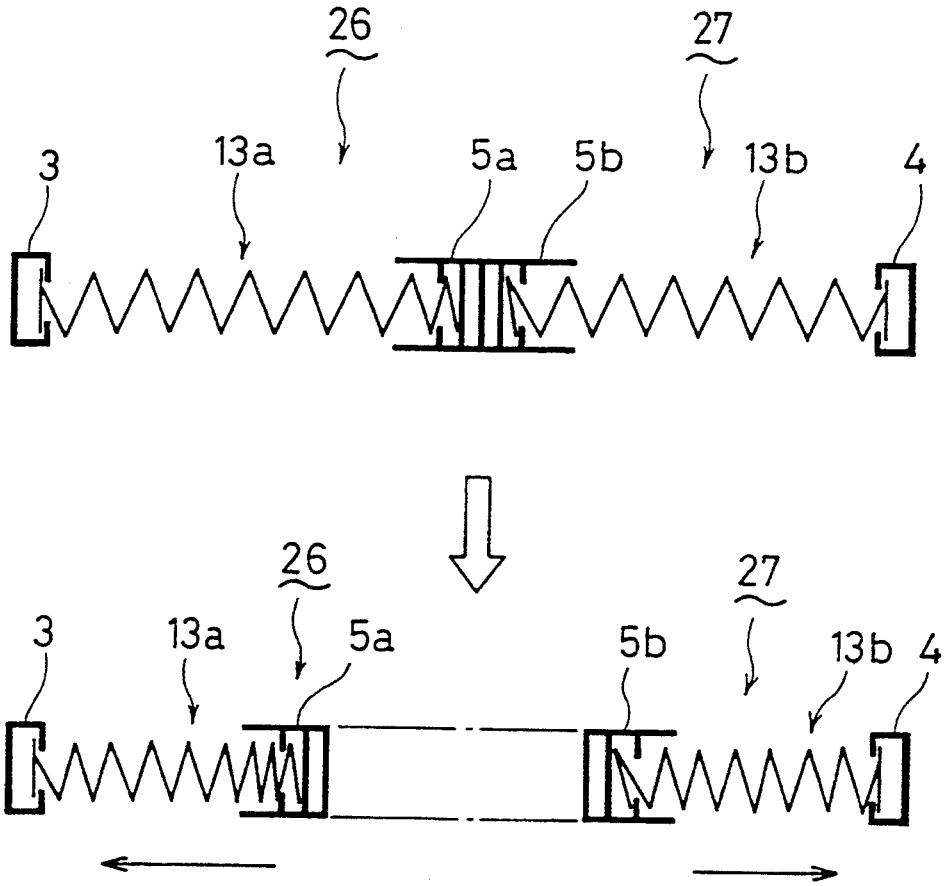
FIG. 13 is a schematic diagram depicting a configuration of a double sliding type of pleated screen device according to the present invention.

Another embodiment shown in FIG. 13 depicts a double sliding type of device in which two pleated screen devices as described above are symmetrically disposed between the pair of right and left frame members (3) and (4).

More specifically, a pleated screen (13*a*) is provided between a frame member (3) and a sliding bar (5*a*) at the left-hand side of the device (26). Similarly, a pleated screen (13*b*) is provided between a frame member (4) and a sliding bar (5*b*) at the right-hand side of the device (27).

Figure 14:
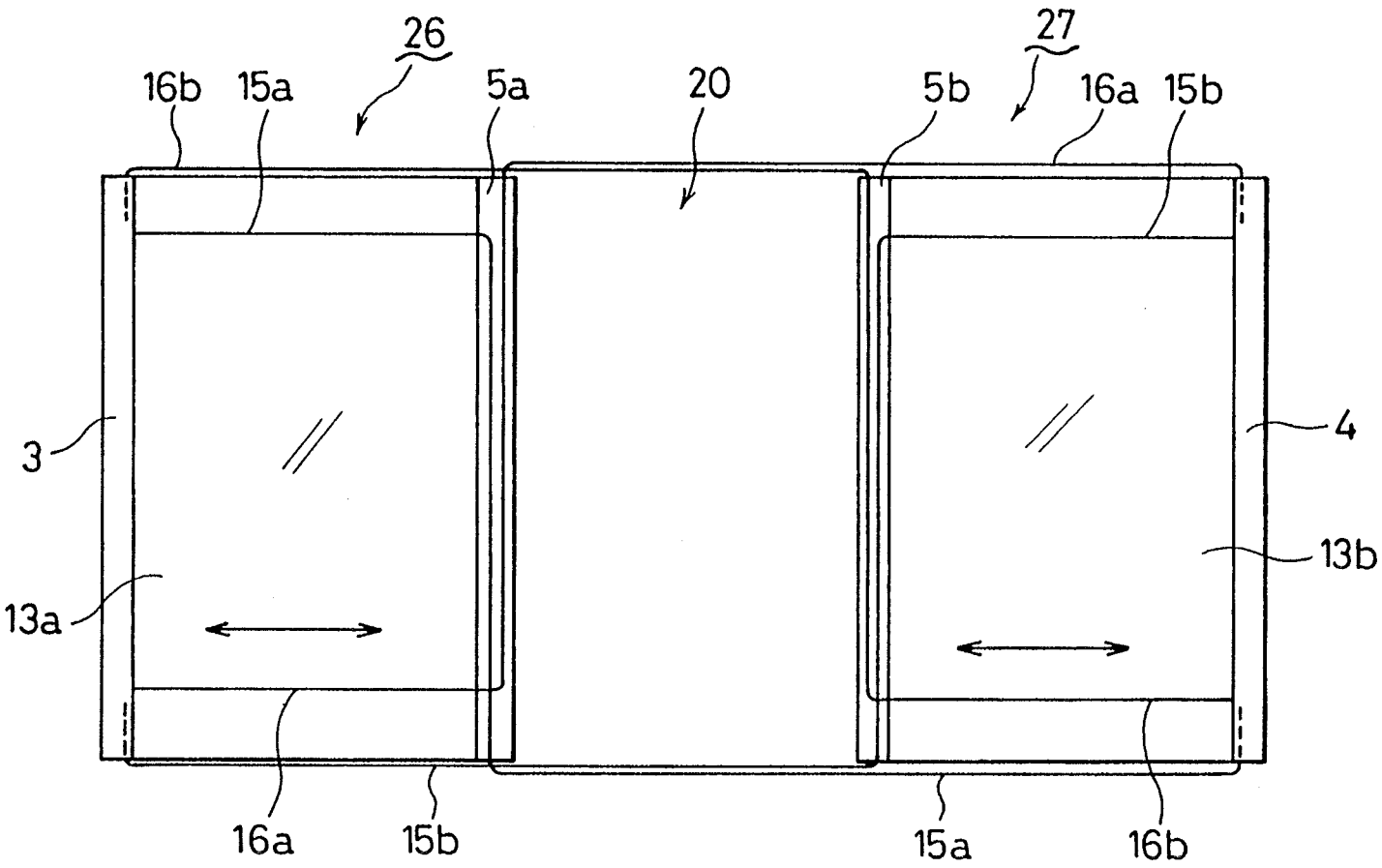
FIG. 14 shows a configuration of another form of the wire used in the pleated screen device shown in FIG. 13.
Figure 15:
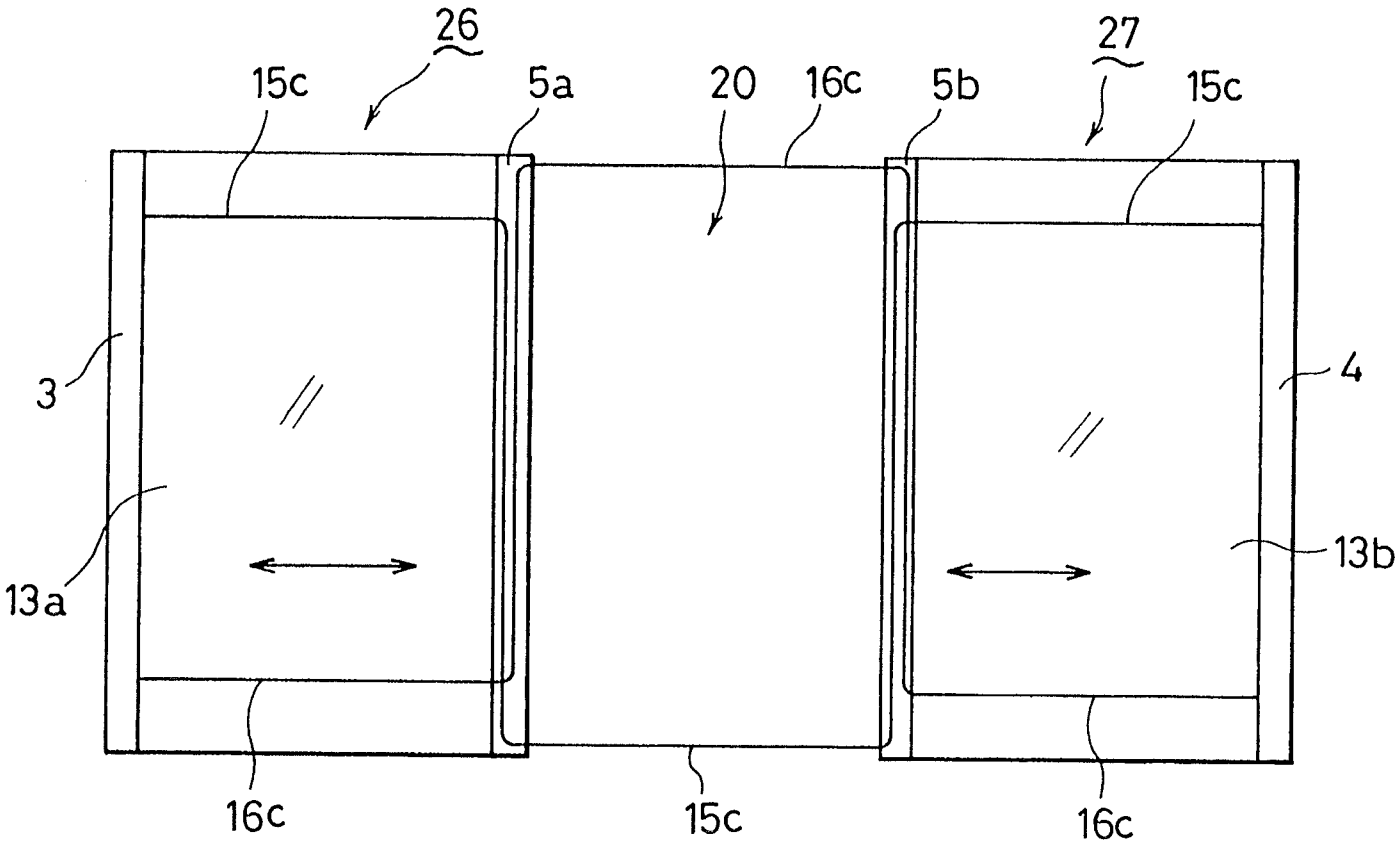
FIG. 15 shows another configuration of the wire.

Configurations of wire members which may be employed in the embodiment shown in FIG. 13 are illustrated in FIGS. 14 and 15.

As shown in FIG. 14, a cord (15*a*) which is fixed to the frame member (3) and horizontally supports the upper portion of the pleated screen member (13*a*) of the pleated screen device is turned in the sliding bar (5*a*) into a frame member (not shown) under an opening (20). The frame member is similar to the frame member (2) shown in FIG. 1. The cord (15*a*) is then secured to another frame member (4) opposed to the frame member (3).

Similarly, a cord (16*a*) which horizontally supports the lower portion of the pleated screen (13*a*) is turned in the sliding bar (5*a*), crosses over the cord (15*a*), extends into the opening (20) and a frame member (not shown), which corresponds to the frame member (1) shown in FIG. 1, provided in the upper portion of the pleated screen device, and is secured to the frame member (4).

At the right-hand side of the pleated screen device (27), the cords (15*b*) and (16*b*) horizontally support a pleated screen (13*b*), are turned in the sliding bar (5*b*), cross over each other and are stretched with a prescribed tension between the frame members (3) and (4).

In the embodiment shown in FIG. 15, on the other hand, a cord (15*c*) which is fixed to a frame member (3) and horizontally supports the upper portion of a pleated screen (13*a*) is turned in a sliding bar (5*a*) into a frame member (not shown) under an opening (20). The cord (15*c*) is then turned again in a sliding bar (5*b*) of the right-hand side of the pleated screen device (27), horizontally supports the upper portion of a pleated screen (13*b*), and is secured to a frame member (4). A cord (16*c*) which is fixed to the frame member (3) and supports the lower portion of the pleated screen member (13*a*) of the left-hand side of the pleated screen device (26) is turned in the sliding bar (5*a*), cross over the cord (15*c*), and extends into a frame member provided above the opening (20). The cord (16*c*) is turned again in the sliding bar (5*b*), supports the lower portion of a pleated screen (13*b*), and is fixed to the frame member (4).

In the embodiments described above, the number of cords stretched between the frame members (3) and (4) is few, and the device has a simple structure which can be manufactured at a Low cost. In the embodiment shown in FIG. 15, any one of the upper or the lower runs of the cords (15*c*) and (16*c*) should preferably be supported by a frame member extending in the opening-closing direction of the device (corresponding to the frame member (1) or (2) shown in FIG. 1) in order to stably hold the sliding bars (5*a*) and (5*b*) when stopped and during their travel.

In the double sliding type of pleated screen device, the intermediate wire member(s) shown in FIGS. 10, 11 and 12 may appropriately be provided between the cords (15*a*), (16*a*), (15*b*), (16*b*), (15*c*) and (16*c*) and turned in the sliding bars (5*a*) and (5*b*).

Figure 16:
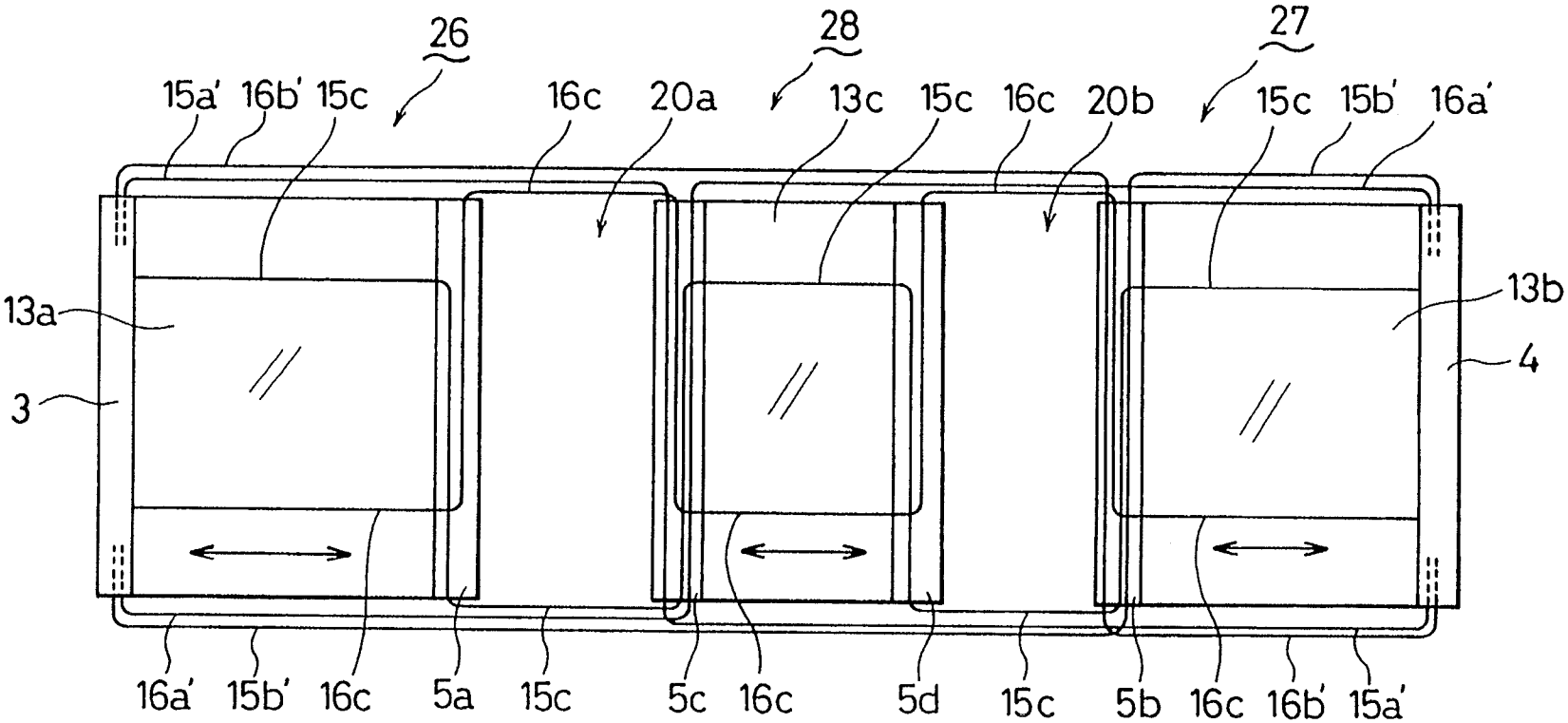
FIG. 16 shows a configuration of an embodiment of a large double sliding type of pleated screen device according to the present invention.

FIG. 16 depicts a large pleated screen device based on a combination of the embodiments of FIGS. 14 and 15.

In this embodiment, an intermediate screen section (28) is provided between pleated screen side sections (26) and (27) respectively fixed to right and left frame members (3) and (4) so as to form two openings (20*a*) and (20*b*). The intermediate screen section (28) has horizontally slidable sliding bars (5*c*) and (5*d*) at both ends thereof and a pleated screen (13*c*) provided between these sliding bars (5*c*) and (5*d*).

Similarly to the embodiment shown in FIG. 15, cords (15*c*) and (16*c*) are turned in the sliding bars (5*a*), (5*c*), (5*d*) and (5*b*), horizontally support three pleated screen members (13*a*), (13*b*) and (13*c*) while crossing over each other, and are secured to the right and left frame members (3) and (4). At portions of the device other than at the left (26) and right-hand sides (27) and intermediate (28) portion of the device, the cords (15*c*) and (16*c*) extend into upper and lower frame members (not shown) corresponding to the frame members (1) and (2) shown in FIG. 1.

On the other hand, cords (15*a*′) and (16*a*′) do not directly support the screens at the left- and right-hand sides of the device (26) and (27) but extend between the frame members (3) and (4) and are turned in the sliding bar (5*c*) of the intermediate screen (13*c*) and cross over each other. These cords (15*a*′) and (16*a*′) firmly support the intermediate pleated screen (13*c*). Portions of the cords (15*a*′) and (16*a*′) except for those in the sliding bar (5*c*) extend into the upper and lower frame members in the manner shown in FIG. 1. Cords (15*b*′) and (16′*b*) are also turned in the sliding bar (5*b*), cross over each other, and are stretched between the frame members (3) and (4).

With such a configuration of wire members, it is possible to stably and smoothly open and close the right and left pleated screens and the intermediate screen, to form a good view of the exterior, and to allow a user to access the device without any trouble.

There is no limitation regarding the number of intermediate portions (28) of the screen device. The wire may be configured based on an appropriate combination of the basic configurations shown in FIGS. 14 and 15 taking into account the operability and stability of the device. Intermediate wire as shown in FIGS. 10, 11 and 12 may be provided if necessary.

Furthermore, the present invention may be applied to provide a pleated screen device capable of being vertically opened and closed. Embodiments of such devices are illustrated in FIGS. 17 and 18.

Figure 17:
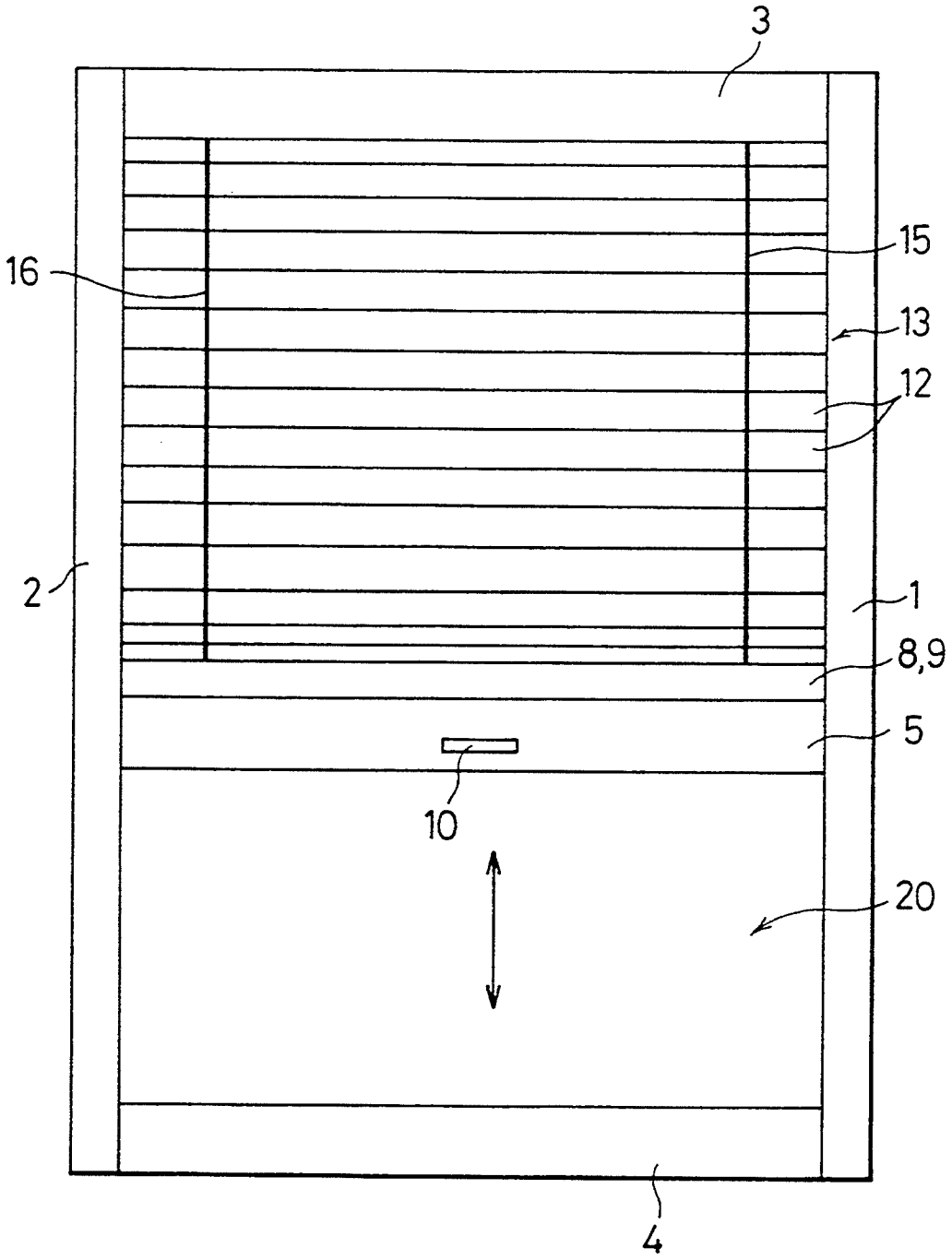
FIG. 17 is a front view of a vertical opening type of pleated screen device according to the present invention.
Figure 18:
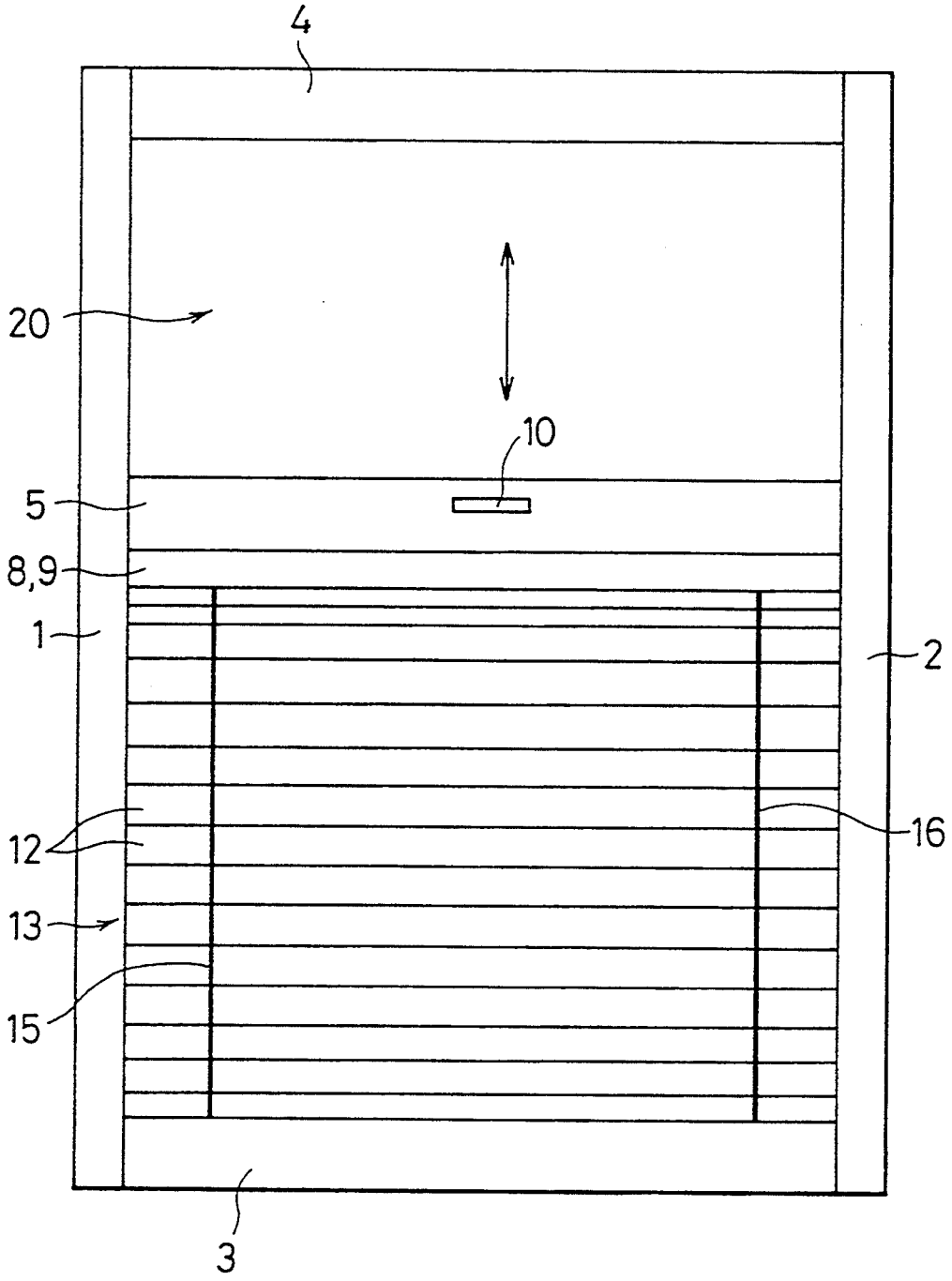
FIG. 18 is a front view of another embodiment of a vertical opening type of pleated screen device.

In the embodiments shown in FIGS. 17 and 18, a pleated screen member (13) may be spread by being pulled up or pulled down to shut the opening (20). In this case, the door roller (11) and the ceiling plate (13), if not necessary, may be omitted.

A pleated screen device of the present invention, as described above, is applicable not only for use as a curtain or a blind for an ordinary window but also as a curtain or a blind for an inclined window such as a skylight or a window of a vehicle as well as a partition in a house or an office building. The device is also applicable for use as a screen or screen door for shutting out insects. Sliding movement of the sliding bar may be accomplished by a conventional operating cord or electrically by incorporating an appropriate drive means in addition to the knob (10) shown in FIG. 2.

Needless to say, the present invention is not limited to the above-mentioned embodiments. Various modifications will become apparent to those skilled in the art. Such modifications are seen to be within the true spirit and scope of the invention as defined by the appended claims.

What I claim:

1. A pleated screen device comprising: a frame; at least one sliding bar mounted to said frame so as to be slidable in opening/closing directions; at least one foldable and spreadable pleated screen, one end of each said screen being secured to a respective said sliding bar; a wire tension system including wire extending through said sliding bar and across the device in said opening/-closing directions, at least one of the ends of the wire being fixed in the device, said wire supporting said pleated screen at sides of the pleated screen opposite one another in said opening/closing directions; and direction changing members disposed in said sliding bar, said direction changing members each having an arcuate guide surface over which said wire extends and is guided to smoothly change the direction in which the wire is extending when it meets the guide surface, said direction changing members guiding portions of said wire to cross over one another within said sliding bar.

2. A pleated screen device as claimed in claim 1, wherein said wire includes first and second cords each extending through said pleated screen, and the wire of said wire tension system includes at least one intermediate cord supporting and extending through said pleated screen between said first and second cords, each said at least one intermediate cord extending through said sliding bar and over the arcuate guide surfaces of a plurality of said direction changing members so as to be guided thereby.

3. A pleated screen device as claimed in claim 1, wherein each said sliding bar has a housing portion in which said one end of a respective said pleated screen is housed.

4. A pleated screen device as claimed in claim 1, wherein said frame is a sash frame of a window.

5. A pleated screen device comprising: a frame including two pairs of frame members, the frame members of one of said pairs being spaced vertically from one another, and the frame members of the other of said pairs being spaced horizontally from one another; a sliding bar mounted to said frame so as to be slidable in opening/closing directions toward and away from the frame members of one of the pairs thereof, respectively; a foldable and spreadable pleated screen supported between said sliding bar and one of said frame members opposed thereto in said opening/closing directions; a wire tension system including wire comprising two cords stretched between and extending into the frame members toward and away from which the sliding bar is slidable in said opening/closing directions, said cords each supporting said pleated screen in said opening/-closing directions; and direction changing members disposed in said sliding bar, said direction changing members each having an arcuate guiding surface over which the wire of said wire tension system extends and is guided to smoothly change the direction in which the wire is extending when it meets the guide surface, each of said cords extending over a guide surface of a plurality of said direction changing members and guided thereby to cross over one another within said sliding bar.

6. A pleated screen device comprising: a frame including two pairs of frame members, the frame members of one of said pairs being spaced vertically from one another, and the frame members of the other of said pairs being spaced horizontally from one another; two sliding bars each mounted to said frame so as to be slidable in opening/closing directions toward and away from the frame members of one of the pairs thereof, respectively; foldable and spreadable pleated screens each supported between a respective one of said sliding bars and one of the frame members opposed thereto in said opening/closing directions; a wire tension system including wire comprising two pairs of cords stretched between and extending into the frame members toward and away from which the sliding bars are slidable in said opening/closing directions, each said pair of the cords supporting only a respective one of said pleated screens in the opening/closing directions; and direction changing members disposed in each of said sliding bars, said direction changing members each having an arcuate guiding surface over which the wire of said wire tension system extends and is guided to smoothly change the direction in which the wire is extending when it meets the guide surface, each pair of said cords extending over the guide surface of the plurality of direction changing members in only one of the sliding bars and guided thereby to cross over one another within the one said sliding bar.

7. A pleated screen device comprising: a frame including two pairs of frame members, the frame members of one of said pairs being spaced vertically from one another, and the frame members of the other of said pairs being spaced horizontally from one another; two sliding bars each mounted to said frame so as to be slidable in opening/closing directions toward and away from the frame members of one of the pairs thereof, respectively; foldable and spreadable pleated screens each supported between a respective one of said sliding bars and one of the frame members opposed thereto in said opening/closing directions; a wire tension system including wire comprising two cords stretched between and extending into the frame members toward and away from which the sliding bars are slidable in said opening/closing directions, each of said cords supporting both of said pleated screens in said opening/closing directions; and direction changing members disposed in each of said sliding bars, said direction changing members each having an arcuate guiding surface over which the wire of said wire tension system extends and is guided to smoothly change the direction in which the wire is extending when it meets the guide surface, each of said cords extending over the guide surface of a plurality of the direction changing members in each of said sliding bars and guided thereby to cross over one another in each of said sliding bars.

8. A pleated screen device comprising: a frame including two pairs of frame members, the frame members of one of said pairs being spaced vertically from one another, and the frame members of the other of said pairs being spaced horizontally from one another; an even number of at least four sliding bars mounted to said frame, two of said sliding bars being slidable in opening/closing directions toward and away from the frame members of one of the pairs thereof, respectively, the other sliding bars being associated with one another in pairs, the sliding bars of each said pair being slidable in said opening/closing directions toward and away from one another; at least three pleated screens, each of two of said screens being supported between a respective one of said two of said sliding bars and one of the frame members opposed thereto in said opening/closing directions, and each of the other pleated screens being supported between the sliding bars of a respective said pair thereof; a wire tension system including wire comprising an even number of cords stretched between and extending into the frame members toward and away from which said two of the sliding bars are slidable in said opening/closing directions, each of said cords supporting at least one of said pleated screens in said opening/closing directions; and direction changing members disposed in each of said sliding bars, said direction changing members each having an arcuate guiding surface over which the wire of said wire tension system extends and is guided to smoothly change the direction in which the wire is extending when it meets the guide surfaces, each of said cords extending over the guide surface of a plurality of said direction changing members in at least one of said sliding bars, and two of said cords being guided by the direction changing members to cross over one another in each of said sliding bars.

9. A pleated screen device as claimed in claim 5, wherein the wire of said wire tension system comprises at least one intermediate cord supporting and extending through said pleated screen between said two cords, each said at least one intermediate cord extending through said sliding bar and over the arcuate guide surfaces of a plurality of said direction changing members so as to be guided thereby.

10. A pleated screen device as claimed in claim 6, wherein said wire includes at least one intermediate cord supporting and extending through at least one of said pleated screens between the cords of each said pair thereof, each said at least one intermediate cord extending through at least one of said sliding bars and over the arcuate guide surface of a plurality of said directions changing members in each said at least one of said sliding bars so as to be guided thereby.

11. A pleated screen device as claimed in claim 7, wherein said wire includes at least one intermediate cord supporting and extending through at least one of said pleated screens between said two cords, each said at least one intermediate cord extending through at least one of said sliding bars and over the arcuate guide surface of a plurality of said directions changing members in each said at least one of said sliding bars so as to be guided thereby.

12. A pleated screen device as claimed in claim 8, wherein said wire includes at least one intermediate cord supporting and extending through at least one of said pleated screens between the cords of a respective pair thereof that support said screen, each said at least one intermediate cord extending through at least one of said sliding bars and over the arcuate guide surface of a plurality of said directions changing members in each said at least one of said sliding bars so as to be guided thereby.

13. A pleated screen device as claimed in claim 2, wherein each said sliding bar has a housing portion in which said one end of a respective said pleated screen is housed.

14. A pleated screen device as claimed in claim 5, wherein each said sliding bar has a housing portion in which said one end of a respective said pleated screen is housed.

15. A pleated screen device as claimed in claim 6, wherein each said sliding bar has a housing portion in which said one end of a respective said pleated screen is housed.

16. A pleated screen device as claimed in claim 7, wherein each said sliding bar has a housing portion in which said one end of a respective said pleated screen is housed.

17. A pleated screen device as claimed in claim 8, wherein each said sliding bar has a housing portion in which said one end of a respective said pleated screen is housed.

18. A pleated screen device as claimed in claim 9, wherein each said sliding bar has a housing portion in which said one end of a respective said pleated screen is housed.

19. A pleated screen device as claimed in claim 10, wherein each said sliding bar has a housing portion in which said one end of a respective said pleated screen is housed.

20. A pleated screen device as claimed in claim 11, wherein each said sliding bar has a housing portion in which said one end of a respective said pleated screen is housed.

21. A pleated screen device as claimed in claim 12, wherein each said sliding bar has a housing portion in which said one end of a respective said pleated screen is housed.

* * * * *